US010702721B2

(12) United States Patent
Perusse et al.

(10) Patent No.: US 10,702,721 B2
(45) Date of Patent: Jul. 7, 2020

(54) HAT AND AIR FILTRATION SYSTEM

(71) Applicants: Steve H. Perusse, Mendota Heights, MN (US); Joy Salvatin Lee, Carlsbad, CA (US); Carl Tedesco, Carlsbad, CA (US); Steve Harrington, Carlsbad, CA (US)

(72) Inventors: Steve H. Perusse, Mendota Heights, MN (US); Joy Salvatin Lee, Carlsbad, CA (US); Carl Tedesco, Carlsbad, CA (US); Steve Harrington, Carlsbad, CA (US)

(73) Assignee: Poma 22 LLC, Mendota Heights, MN (US)

( * ) Notice: Subject to any disclaimer, the term of this patent is extended or adjusted under 35 U.S.C. 154(b) by 282 days.

(21) Appl. No.: 15/656,557

(22) Filed: Jul. 21, 2017

(65) Prior Publication Data

US 2018/0021607 A1 Jan. 25, 2018

Related U.S. Application Data

(60) Provisional application No. 62/493,926, filed on Jul. 22, 2016.

(51) Int. Cl.
*A62B 18/00* (2006.01)
*A62B 7/10* (2006.01)
(Continued)

(52) U.S. Cl.
CPC ..... *A62B 18/003* (2013.01); *A42B 3/283* (2013.01); *A42B 3/286* (2013.01); *A62B 7/10* (2013.01); *A62B 19/00* (2013.01)

(58) Field of Classification Search
CPC ..... A62B 18/003; A62B 18/006; A62B 18/04; A62B 7/10; A42B 3/28; A42B 3/283; A42B 3/286; A42B 3/0406; A45D 20/45
See application file for complete search history.

(56) References Cited

U.S. PATENT DOCUMENTS 2,032,101 A 2/1936 Sullivan
2,333,054 A 10/1943 Sullivan
(Continued)

FOREIGN PATENT DOCUMENTS

CA 2720226 A1 * 12/2009 ..... A62B 23/02
DE 3306691 9/1984
(Continued)

OTHER PUBLICATIONS

Behn, Eric, Gear Review: Specialized Dissident Helmet, Jun. 7, 2013, Snow Brains. [online] [retrieved on Aug. 14, 2019] <URL:https://snowbrains.com/dissident-review/> (Year: 2013).*
(Continued)

*Primary Examiner* — Bradley H Philips
*Assistant Examiner* — Savannah L Gabriel
(74) *Attorney, Agent, or Firm* — Tysver Beck Evans

(57) ABSTRACT

A hat includes a shell, and an air filtration system for providing a protective stream of air across the face of the wearer of the hat. The shell defines an exterior of the hat. At the back of the shell is a fan housing which contains a fan and defines an interior through which air is passed through the hat. The filtration system includes a filter cartridge and a retaining basket. The filter cartridge includes a filter medium. The filter system is removeably positioned adjacent to and across the fan housing so as to filter air passing into the interior of the hat. The filter cartridge is removeably engaged to the retaining basket. The retaining basket retains the cartridge to the hat and ensures proper positioning of the filter cartridge.

20 Claims, 13 Drawing Sheets

(51) Int. Cl.
*A42B 3/28* (2006.01)
*A62B 19/00* (2006.01)

(56) References Cited

U.S. PATENT DOCUMENTS

| | | | | |
|---|---|---|---|---|
| 2,688,962 | A | 9/1954 | Summers | |
| 3,813,696 | A | 6/1974 | Yeager | |
| 3,881,478 | A | 5/1975 | Rosendahl et al. | |
| 3,925,821 | A | 12/1975 | Lewicki | |
| 4,227,520 | A | 10/1980 | Lord | |
| 4,462,399 | A * | 7/1984 | Braun | A62B 18/045 128/201.24 |
| 4,803,979 | A | 2/1989 | Fischer | |
| 5,050,240 | A | 9/1991 | Sayre | |
| 5,283,914 | A * | 2/1994 | James | A42B 3/16 128/201.24 |
| 5,577,495 | A | 11/1996 | Murphy | |
| 5,592,936 | A | 1/1997 | Thomas, Jr. et al. | |
| 6,081,929 | A | 7/2000 | Rothrock et al. | |
| 6,513,168 | B2 | 2/2003 | Paris et al. | |
| 6,810,532 | B2 | 11/2004 | Wang Lee | |
| 6,904,616 | B1 | 6/2005 | Maki et al. | |
| 6,973,676 | B1 | 12/2005 | Simpson | |
| 6,990,691 | B2 | 1/2006 | Klotz et al. | |
| 7,036,502 | B2 | 5/2006 | Manne | |
| 7,114,194 | B2 | 10/2006 | English | |
| 8,590,062 | B2 | 11/2013 | Gupta | |
| 2003/0182711 | A1 | 10/2003 | Klotz | |
| 2005/0114986 | A1 | 6/2005 | Hobart | |
| 2006/0053528 | A1 | 3/2006 | English | |
| 2007/0044800 | A1 | 3/2007 | Church et al. | |
| 2007/0089221 | A1 | 4/2007 | Manzella, Jr. et al. | |
| 2007/0094768 | A1 | 5/2007 | Moudgill | |
| 2007/0094769 | A1 | 5/2007 | Lakes et al. | |
| 2009/0055987 | A1 | 3/2009 | Becker et al. | |
| 2009/0210989 | A1 | 8/2009 | Becker et al. | |
| 2009/0250060 | A1 | 10/2009 | Hacke et al. | |
| 2010/0294270 | A1 | 11/2010 | Curran et al. | |
| 2012/0167282 | A1 | 7/2012 | Fleming et al. | |
| 2013/0014752 | A1 * | 1/2013 | Ausen | A62B 7/10 128/201.25 |
| 2013/0263364 | A1 | 10/2013 | Green | |
| 2014/0026300 | A1 | 1/2014 | Silveira | |

FOREIGN PATENT DOCUMENTS

| | | | | |
|---|---|---|---|---|
| DE | 3306692 | | 9/1984 | |
| WO | WO-2016016710 | A1 * | 2/2016 | A42B 3/24 |

OTHER PUBLICATIONS

Jan. 11, 2016 PCT Preliminary Examination Report (Serial No. PCT/US14/67157).
Oct. 2, 2017 USPTO Office Action (U.S. Appl. No. 15/369,205).
Oct. 23, 2015 PCT Preliminary Examination Report (Serial No. PCT/US14/67157).
Mar. 3, 2015 PCT Search Report (Serial No. PCT/US14/67157).
3M Respiratory Products, http://www.westernsafety.com/3m/3mrespiratorypg4.html, p. 1-17, May 21, 2013.
Mar. 23, 2016 USPTO Office Action (U.S. Appl. No. 14/551,854).

* cited by examiner

HAT AND AIR FILTRATION SYSTEM

CROSS-REFERENCE TO RELATED MATTERS

The present application claims priority to U.S. Provisional Patent Application No. 62/493,926, filed Jul. 22, 2016 the entire contents of which are incorporated by reference in its entirety. This application is also related U.S. Pat. No. 9,510,632, which is also incorporated by reference in its entirety.

FIELD OF THE INVENTION

The present application relates to the field of head gear such as helmets, hard hats or other protective head coverings, hereinafter collectively referred to as hats, and particularly those used in industrial settings such as in the painting and construction industries. The present application is also concerned with providing such hats with an air flow and replaceable filtration system configured to aid in protecting the user's eyes and face from airborne particulates and fumes.

SUMMARY

Embodiments of the present disclosure are directed to hats, such as industrial hard hats equipped with a fan that provides a forwardly flowing current of air to prevent paint droplets, or other construction dust, debris or fumes, from impacting on the eyewear or face of a user.

Embodiments of the hat include opening or openings proximal to the front of the hat that point downwards in front of the face of a user. The fan is implemented with a filter in the back of the hat, and filtered air passes through an air passage in the hat before exiting at the openings, thereby causing a stream of filtered air to pass in front of the user's face with sufficient velocity to repel particles of paint, dust, fumes and similar industrial contaminants.

Embodiments of the filtration system include a curved assembly that attaches to the back of the hat and which curves around the sides of the hat to cover the air inlet to the hat. This assembly includes openings which permit the air to pass through to the air passage of the hat. In some embodiments, the air passage is positioned between an exterior shell and an interior framework. The filtration system includes a filtration material that will capture and hold paint particles, drywall dust, silica dust, and other construction debris that may be present in the environment and prevent such materials from entering the air inlet of the hat, thereby ensuring filtered clean air is pushed through the perforations of the bill/brim to form an air curtain barrier.

A replaceable filter cartridge is provided that matches the construction of a filter frame. The filter cartridge comprises filter material is surrounded by a cage. The filter cage has a plurality of cross-struts that extend from one side of the filter cage to the other. The top and bottom of the filter cage are curved, allowing the filter cartridge to be bent into a partial conical shape that corresponds to a similar shape of a basket that completes the filtration system. In one embodiment, the cross-struts in the filter cartridge are designed to correspond to the cross-struts in the filter frame so as to not impede air flow through the filter material.

DETAILED DESCRIPTION

Figure 1:
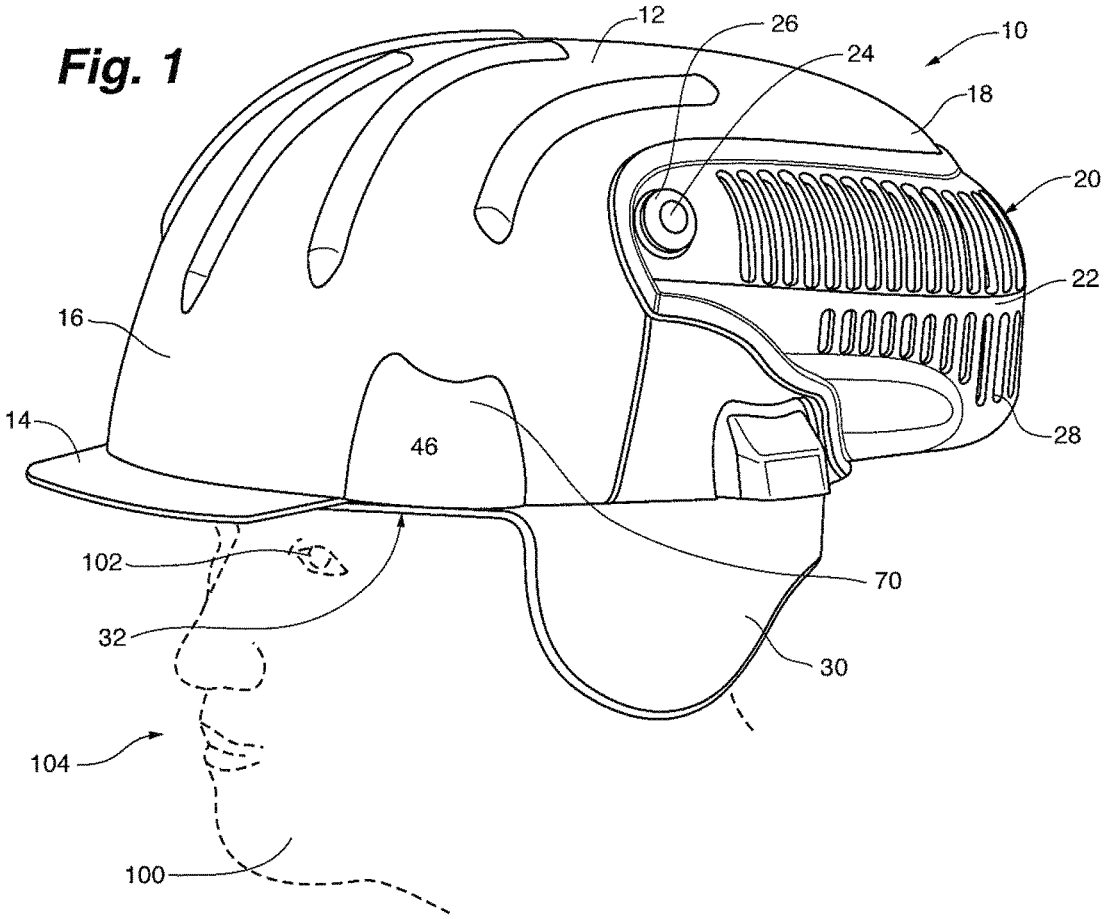
FIG. 1 is a perspective view illustrating an embodiment of a filtration system equipped hard hat.

As mentioned above, embodiments of the present disclosure are provided in the form of a hat, helmet or other protective head gear such as a hard hat 10 shown in FIG. 1. The hard hat 10 may be of any style or configuration and may be of uniform or customized size, such that a variety of individual wearers or users 100 may wear the hard hat 10 for prolonged periods of time, and in a variety of environments.

In its most basic form the hard hat 10 includes a shell 12, a bill or brim (hereinafter "bill") 14 at the front or face 16 of the shell 12 and a back 18 of the shell 12 where a filter system 20 is attached. The filter system 20 is a part of the hard hat 10 but is removably engaged thereto and is discussed in greater detail below.

In some embodiments, the hard hat 10 includes protective ear flaps or coverings 30 that extend from the base or bottom 32 of opposing sides of the hard hat 10 to provided physical and/or auditory protection to the ears (not visible) of the wearer 100.

In some embodiments, the hard hat 10 may include a transparent eye/face shield (not shown) which extends from the base 32 of the hard hat 10 adjacent to the bill 14 and/or front 16 to provide protection to the eyes 102 and/or face 104 of the wearer 100.

As is shown in FIG. 1, at the back 18 of the shell 12 is positioned the removable filter system 20. When engaged to the back 18 of the shell 12, the filter system 20 is visible as a retaining or support basket 22 of material similar or distinct from that of the shell 12. The basket 22 curves around the back 18 of the shell 12 and extends between two mounting knobs 24 located on offset or opposing sides of the shell 12. The basket 22 is equipped with correspondingly shaped and positioned protrusions 26, which comprise internal recesses designed to receive and removeably engage and hold a knob 24 of the shell 12. When the knobs 24 on both sides of the shell 12 are received within the protrusions, the basket 22 is held in place at the back 18 of the hard hat 10.

The mechanism of the removable engagement provided by the knobs 24 and protrusions 26 may be a mechanical interface (friction or snap fit, screws, fasteners, etc.) and/or by magnetic attraction, such as may be provided by constructing knobs 24 and protrusions 26 with magnetized material of appropriate polarity and position.

Figure 2:
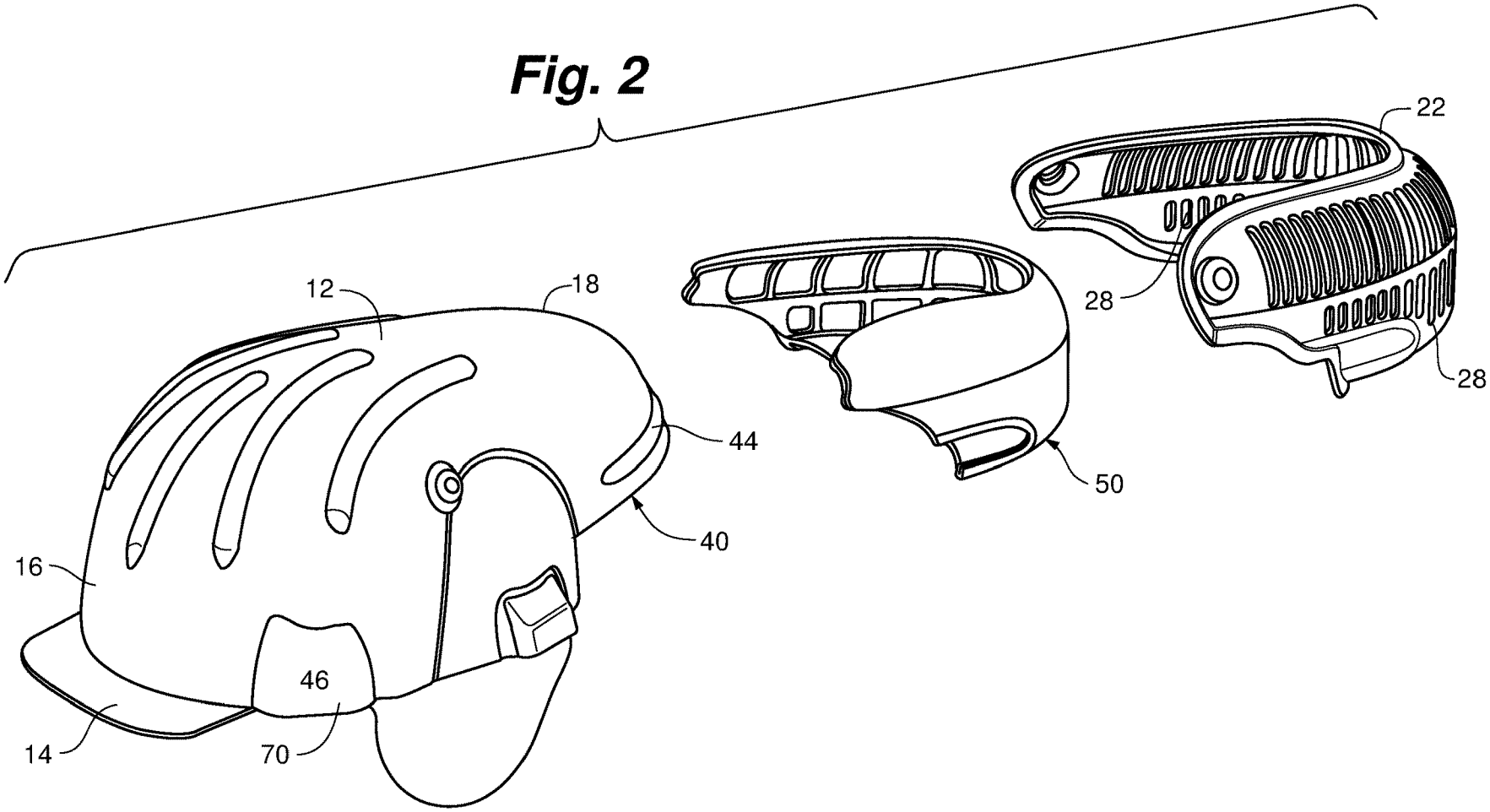
FIG. 2 is a partially exploded view showing elements of the hard hat and filtration system shown in FIG. 1.

Turning to FIG. 2, here the hard hat 10 is shown with components of the filter system 20 visible as a consequence of the basket 22 being disengaged from the shell 12, by separating the protrusions 26 of the basket 22 from the knobs 24 of the shell 12. It should be noted that other engagements mechanisms between the basket and shell may also be provided for at any desired location along or adjacent to their interface (e.g. one or more engagement clips, tabs, hooks, etc.) to provide a further degree of securement to supplement the knob/protrusion engagement describe above.

The hat 10 functions as a result of a fan or blower 42 (not shown in FIG. 1 or 2) that pulls air through the openings 28 defined by the basket 22, and through a filter cartridge 50 into an filtered air receptacle or area 40. This area 40 is defined by the shell 12 of the hat 10, and in operation contains filtered air that has passed through the filter cartridge. The filtered air receptacle has one opening completely covered by the filter system 20, and a second opening at which is positioned the fan/blower 42. When the fan 42 is operating, air within this area 40 passes through the fan 42 itself and into an airflow passage 74 (see FIGS. 12-13). The fan/blower 42 and the airflow passage 74 may be of the type shown and described in U.S. Pat. No. 9,510,632 or of the type shown in FIGS. 4-5 and 12-12 of the present application. The fan 42 has an air-intake 44 in communication with the filtered air area 40, and an fan outlet in communication with the airflow passage 74.

Figure 3:
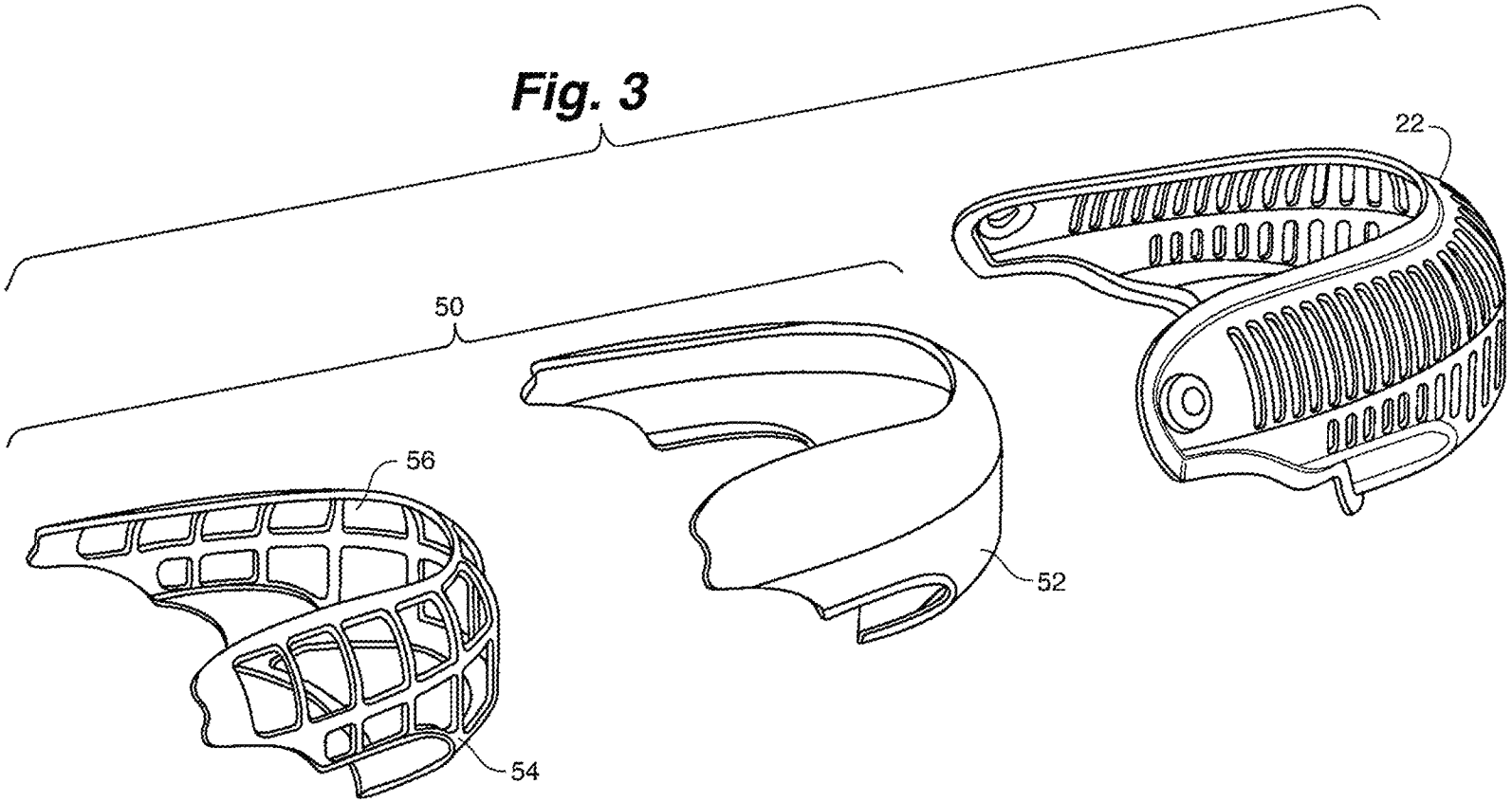
FIG. 3 is a component view of the filtration system shown in FIGS. 1-2.

An embodiment of the filter cartridge 50 is depicted in FIG. 3 wherein the cartridge 50 is shown having a filter medium 52 and supporting cage or frame 54. Filter medium 52 may be any sort of filtration material suitable for the removal of particulate matter suspended in air being drawn therethrough. As air is intended to be drawn and pass through the filter medium 52, the porosity of the medium must be appropriate to that task. However, depending on the intended environment of use the porosity may be varied to allow filtration of suspended particles of solid or liquid; and in some embodiments even some gases (fumes). For example, when the hat 10 is intended for use in conditions involving paint or drywall cutting, the medium 52 may be of a finer type of filtration material than might be used in conditions where larger suspended particles are more likely to be present (saw dust present at a building site, etc.). Some examples of suitable material that may be included in the medium 52 includes but is not limited to: Tyvek, open celled foam, and/or other materials suitable for their use in air filtration systems.

Medium 52 is engaged to support frame 54 through the use of adhesives, mechanical engagement (hook and loop style complementary surfaces for example), or even merely by sandwiching the medium 52 between the frame 54 and basket 22 when the basket 22 is secured to the back 18 of the shell 12 such as in the manner that has been described above. In some embodiments, the cartridge 50 or its individual components (medium 52 and/or frame 54) interact with the knobs 24 and protrusions 26 and is held in place thereby when the basket 22 is properly affixed to the shell 12.

As is shown in FIGS. 2-3, frame 54 defines air flow openings 56 which allows for air to be drawn therethrough to pass through the adjacent medium 52 and into fan 42 through the air-intake 44.

Figure 4:
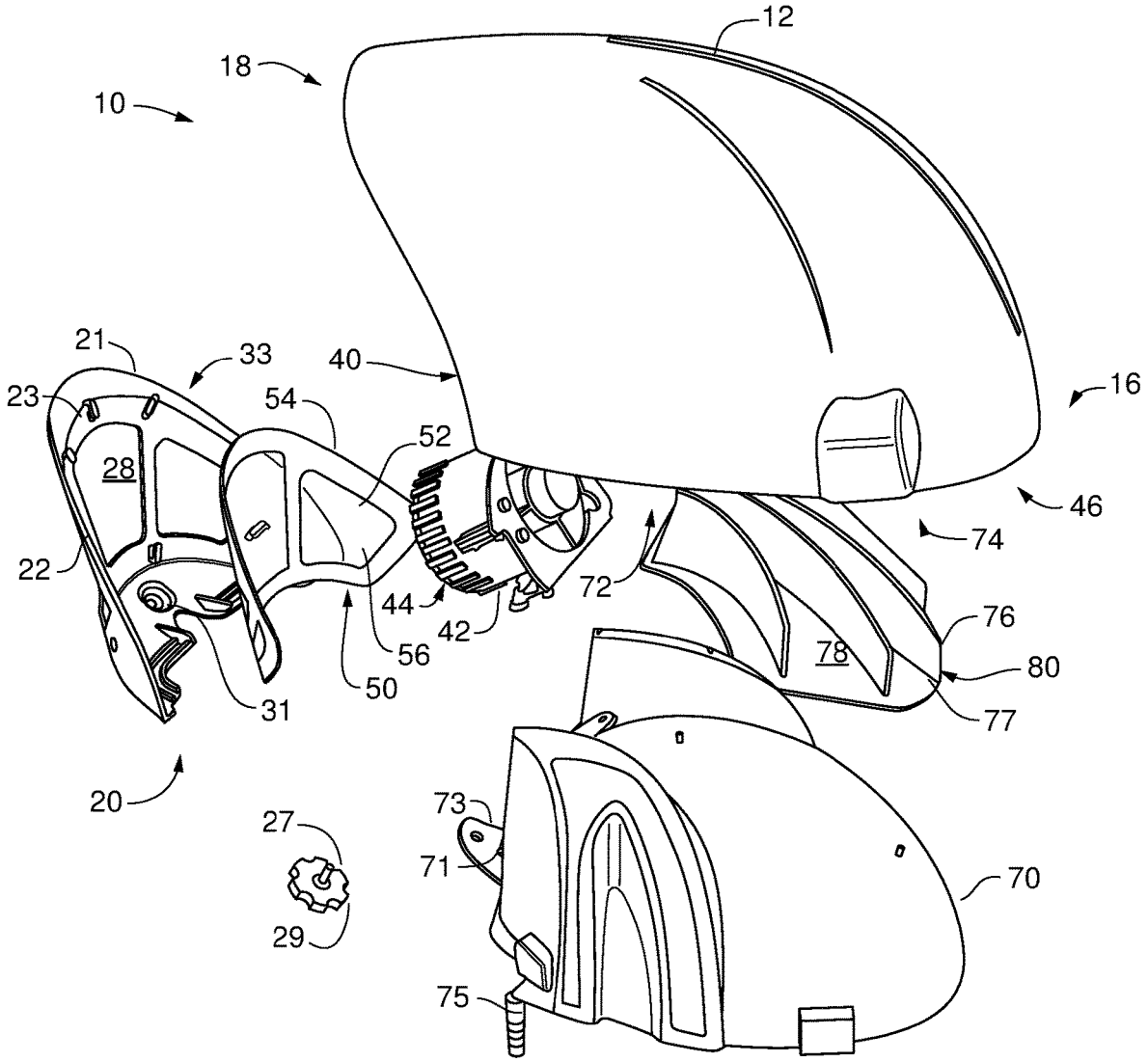
FIG. 4 is a front, right side exploded view of an embodiment of the disclosed hard hat.
Figure 5:
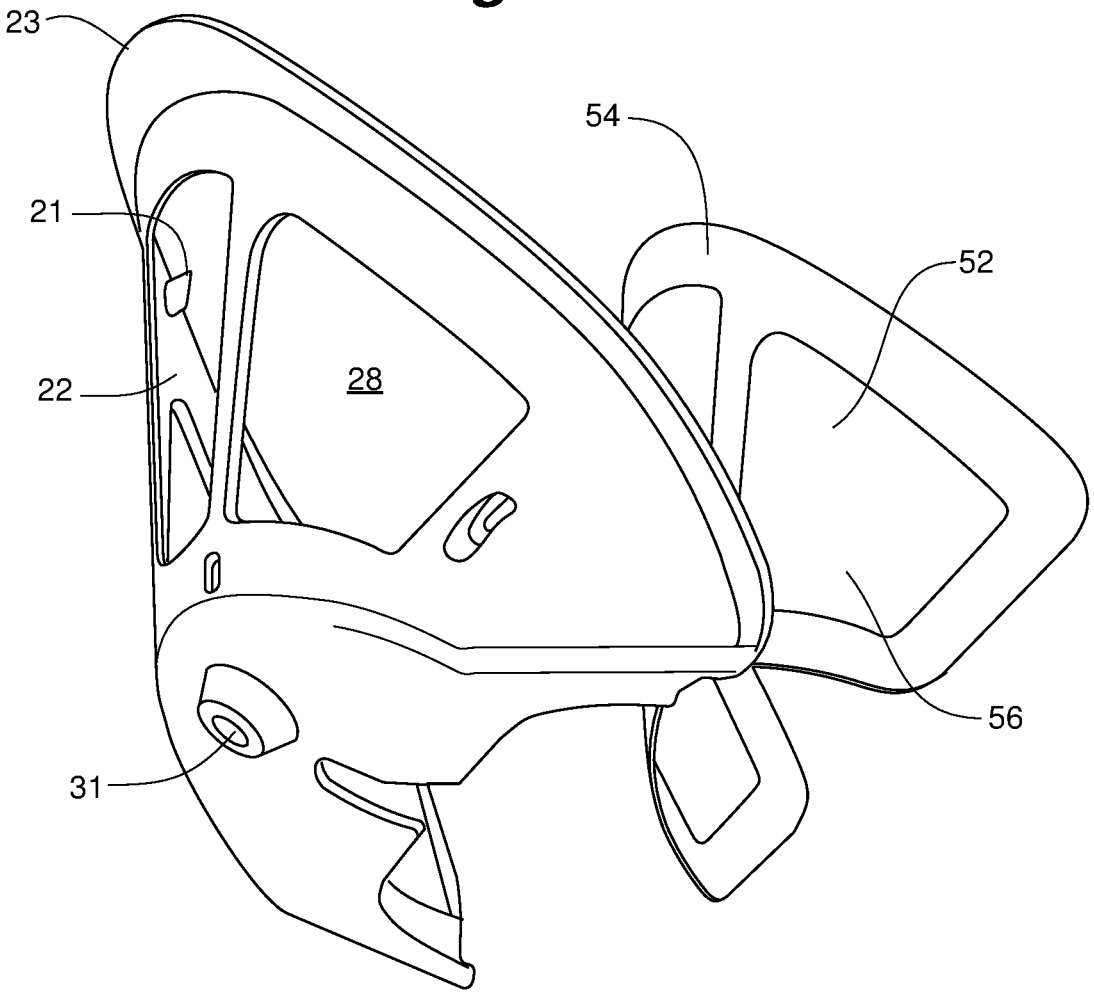
FIG. 5 is a bottom (interior), right side exploded view of the embodiment shown in FIG. 4.
Figure 6:
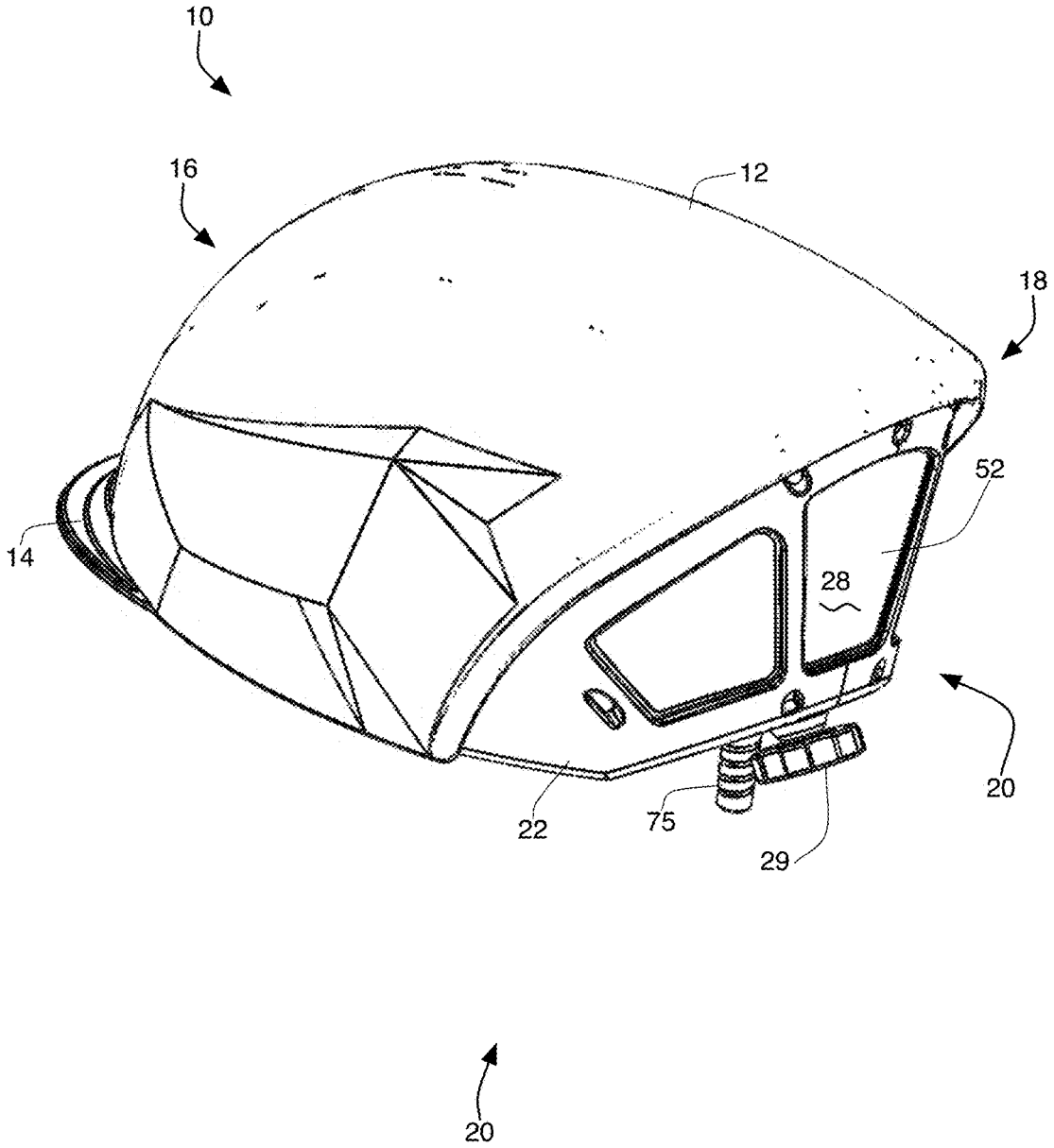
FIG. 6 is an external, left-rear view of assembled hat shown in FIGS. 4-5.

In an alternative embodiment, an example of which is shown in FIG. 4-6 a configuration of the hard hat 10 is shown, which utilizes a basket 22 and filter cartridge 50 that attaches to the back 18 of the shell 12 by way of an engagement lip 23 on the basket 22 that is mechanically received by a receiving surface 25 of the shell 12. The basket 22 and associated filter cartridge 50 is held in place by a threaded member 27 of a knob 29 (hand actuatable), which is passed through a receiver hole 31 located on the bottom of the basket 22. The threaded member 27 passes first through the receiver hole 31 and then is threaded into and engaged by a fixation hole 71 defined by a retaining protrusion 73 of the hard hat's interior framework 70. When thusly assembled, such as in the manner shown in FIG. 6, the air filter system 20 is properly secured to the back 18 of the hard hat 10.

Figure 7:
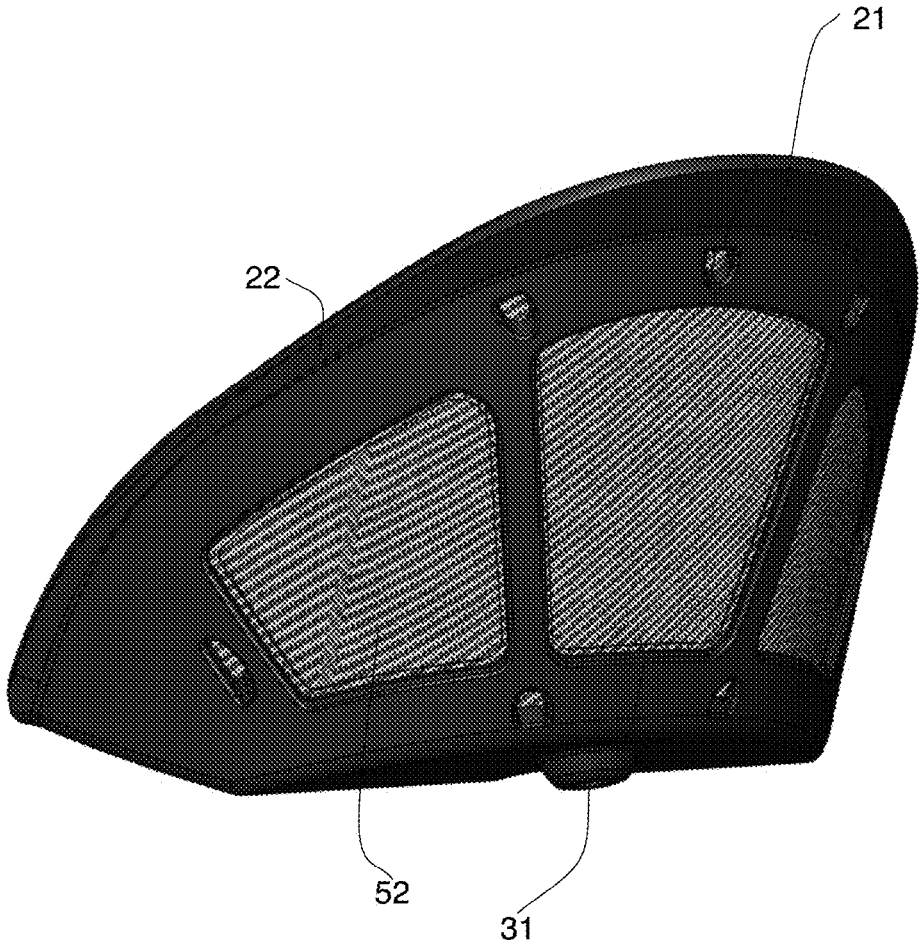
FIG. 7 is a left-rear perspective view of the assembled filtration system shown in FIGS. 4-6.
Figure 8:
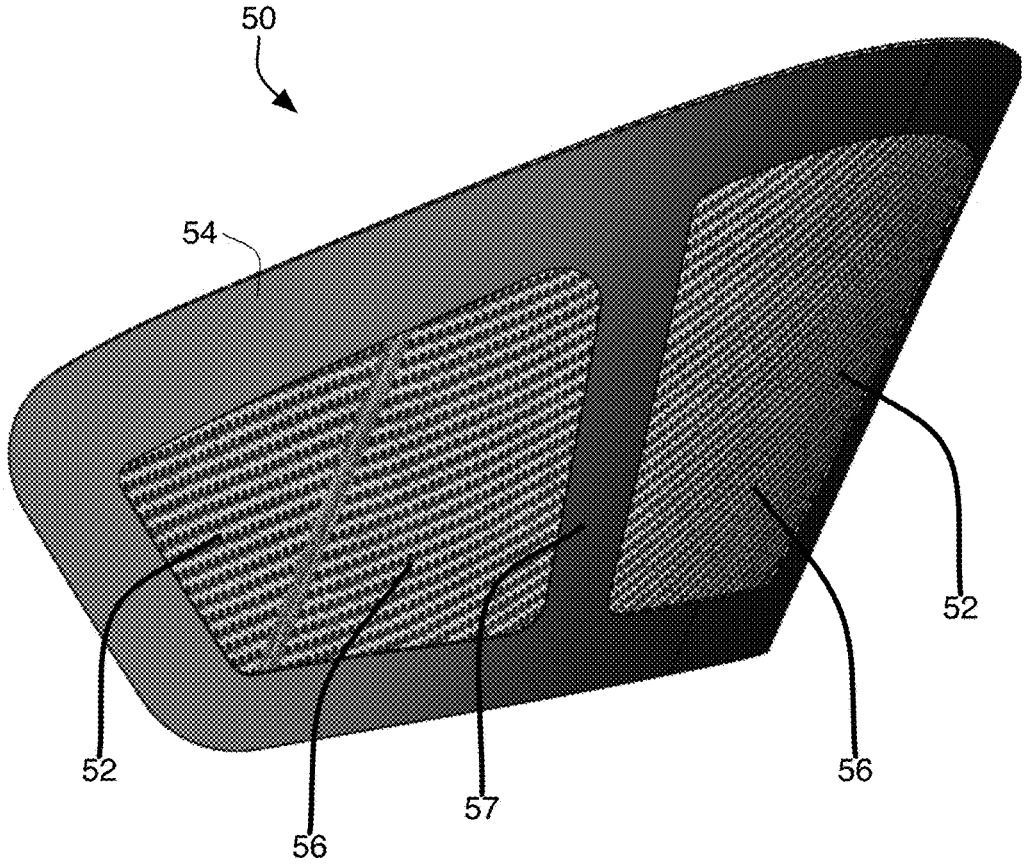
FIG. 8 is a left side perspective view of the filter cartridge used in the embodiments shown in FIGS. 4-7.
Figure 9:
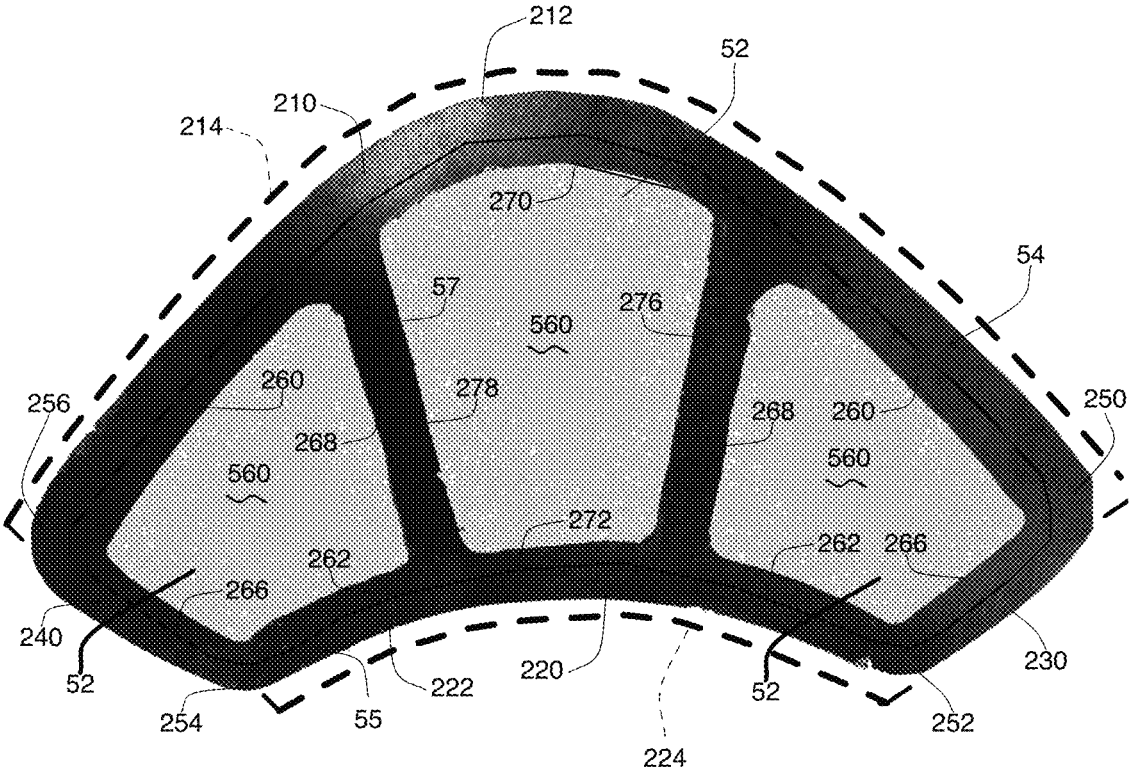
FIG. 9 is a rear view of the cartridge shown in FIG. 8, with the cartridge shown flattened to better illustrate its geometry and construction.

In the embodiment shown in FIGS. 4-6 the filter system 20 also differs from that which is shown in FIGS. 1-3 in its shape and manner of assembly as well. Turning to FIG. 7, the completed filter system 20, including basket 22 and filter cartridge 50, is shown (of filter cartridge 50, only the medium 52 is visible thru the openings 28 of the basket 22, as the entire cartridge 50 is best seen in FIGS. 7-9). In the present embodiment, the cartridge 50 is snap fit, fastened or otherwise engaged into and retained by the basket 22.

As may best be seen in FIG. 4, in at least one embodiment the basket 22 includes a plurality of raised tabs 21 that engage and retain the filter frame 54 against the interior 33 of the basket 22. This manner of engagement between the basket 22 and cartridge 50 is distinct from the embodiment shown in FIGS. 1-3 wherein the cartridge 50 is essentially sandwiched between the basket 22 and shell 12 and retained in place by the engagement of the basket to the shell 12.

Cartridge 50 is shown disengaged from the basket 22 in FIG. 8 (and shown in a flattened state in FIG. 9). The cartridge 50 is a distinct and separable element of the air filter system 20 that is designed to be removable and replaceable. As has been repeatedly discussed, typically the cartridge includes a cage or frame 54 with a filter medium 52 engaged thereto. In the embodiment shown in FIG. 10, the cage 54 is shown without the medium 52 in place. The cage 54 acts as a framework to support the medium 52 and ensure proper alignment and coverage of the medium 52 over the openings 28 of the basket 22 when the cartridge 50 is in place such as in the manner shown in FIGS. 4-5.

In the preferred embodiment such as is shown in FIGS. 8 and 9, the cartridge 50 includes a frame or cage 54 and a medium 52 secured thereto by adhesive, mechanical or other form of engagement. The entire cartridge 50 may be removed from the helmet to be disposed of and then readily replaced with a new cartridge 50. In some embodiments, the cartridge 50 may be rinsed or otherwise cleaned for repeated use.

As indicated above, the cartridge 50 must be configured to ensure that air passing through the openings 28 of the basket 22 is passed through the medium 52 and thusly filtered before passing into the interior of the helmet 10. One way that such proper alignment is ensured is by providing the cartridge 50, and thus the cage 54 and medium 52 with a shape the conforms to that of the basket 22 interior 33 (see FIGS. 4-5).

In the embodiments shown in FIGS. 8-11, and best shown in FIG. 9, the cartridge 50 (and its component cage 54 and medium 52) has a chevron or boomerang-like shape defined by a perimeter 55. A top member 210 of this perimeter 55 has a curved external surface 212 along at least a portion of its length 214. A bottom member 220 of the perimeter 55 has a curved external surface 222 along its entire length 224. The length 214 is greater than the length 224. Each of two linear side members 230 and 240 connect the bottom member 210 and 220 at curved junctions 250, 252, 254 and 256.

In the embodiment shown, cage 54 includes three openings 56 to allow air to pass through the medium 52. As shown and labeled in FIG. 9, the openings are comprised of side openings 56*a* and 56*b* and a central opening 56*c*. Each opening defines an area, wherein in at least one embodiment, the area of each side opening 56*a* and 56*c* is smaller than that of the central opening 56*c*. The openings 56*a*, 56*b* and 56*c* are defined by the cage 54, which includes and two cross-bars 57 that extend across and between the bottom member 210 and top member 220 of the cage 54.

Side openings 56*a* and 56*b* each have four sides. Top side 260, bottom side 262, exterior side 266, and interior side 268 defined by the cage 54. Each of the four sides have has a length, and the length of each of the four sides is different than the other; with the length of the top side 260 being longer than each of the other sides. At least the bottom side 262 is curved along its entire length.

Central opening 56*c* also has four sides. Top side 270 and bottom side 272 are defined by the top member 210 and the bottom member 220 respectively. First interior side 276 and second interior side 278 are each defined by one of the cross-bars 57. Top side 270 has a length longer than the length of the bottom side 272. In some embodiments, the first interior side 276 and the second interior side 278 each have the same length. In at least one embodiment the length of either the first interior side 276 or second interior side 278 is longer that the bottom side 272. At least the top side 270 of the central opening 56*c* is curved.

In some embodiments, the curved bottom sides 262 of the side openings 56*a* and 56*b*, and the bottom side 272 of central opening 56*c* are each curved to the same degree as the curved external surface 222, and thus each of the sides 262 and 272 run parallel to the curved external surface 222 along their relevant and respective lengths. In at least one embodiment, the top side 270 of the central opening 56*c* has the same curve as the curved external surface 212 and runs parallel thereto.

Figure 11:
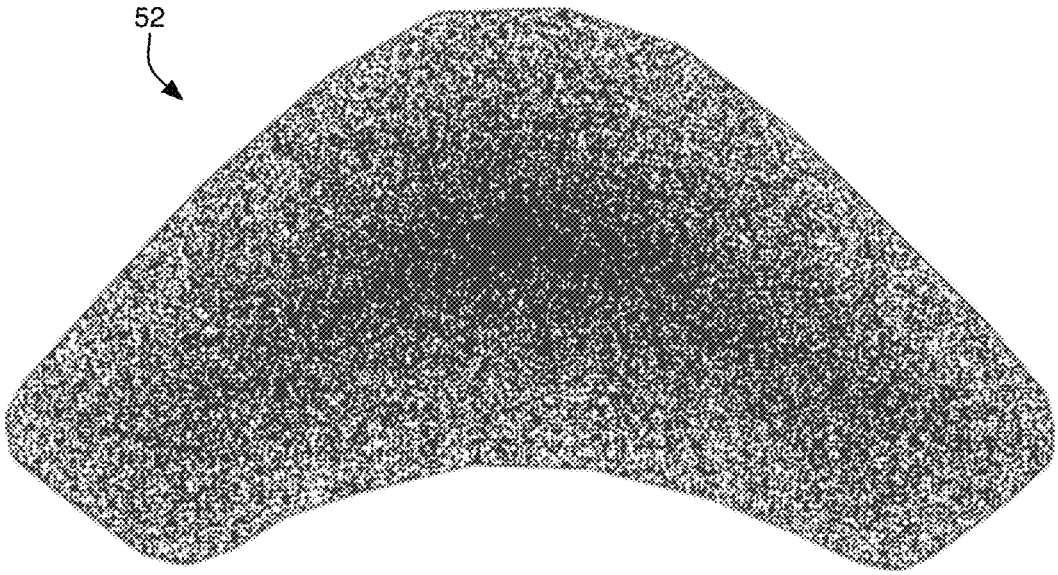
FIG. 11 is a planar view of the filter medium utilized with the cage shown in FIG. 10 to form the cartridge shown in FIGS. 8-9.

The unique size and shape of the cage 54 and medium 52, such as are shown in FIGS. 9 and 11 respectively, ensure that when the assembled cartridge 50 is formed into a partial cone-like or bent state necessary for insertion into the basket 22, such as in the manner shown in FIGS. 4-5. The openings 56 of the cage correspond into an overlapping position with the openings 28 of the basket 22, thereby ensuring that air flowing through both sets of openings 28 and 56 will pass through the filter medium 52 positioned therebetween. The two cross-bars 57 that form part of the cage 54 are design to approximately line-up with similar components in the support basket 22. Two cross-bars 57 are generally sufficient for the cartridge 50 to hold its partial cone-like shape while not significantly interfering with the passing of air through the filter medium 52.

Figure 10:
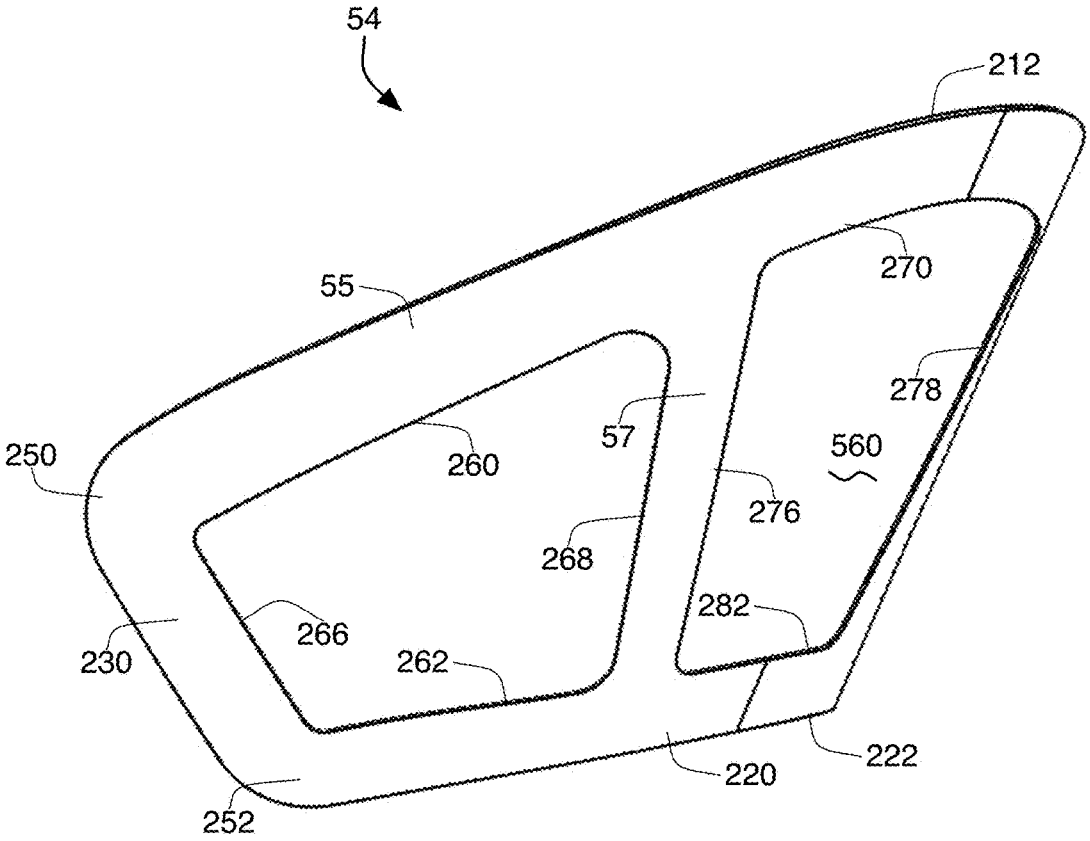
FIG. 10 is a left side perspective view of the cartridge cage shown in FIGS. 8-9.

In some embodiments the filter medium 52, may be separated from the cage 54 such as in the manner shown in FIGS. 10 and 11. While it may be possible to use a properly shaped section of medium 52 (such as is shown in FIG. 11) without the cage 54 (such as is shown in FIG. 10), the lack of a cage 54 will make it difficult if not impossible to properly align the medium over the openings 28 of the basket 22 for significant periods of use.

Figure 12:
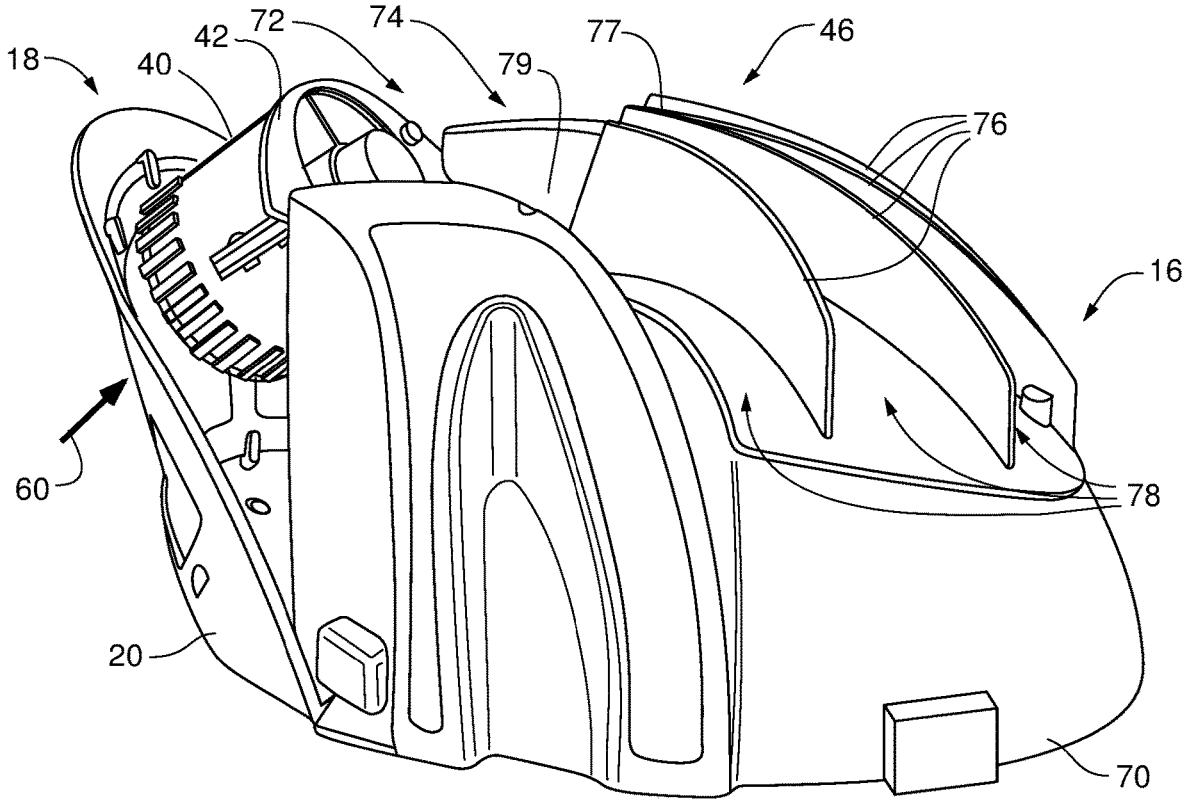
FIG. 12 is an internal perspective view of the embodiment shown in FIGS. 4-5 with the hat shell removed.
Figure 13:
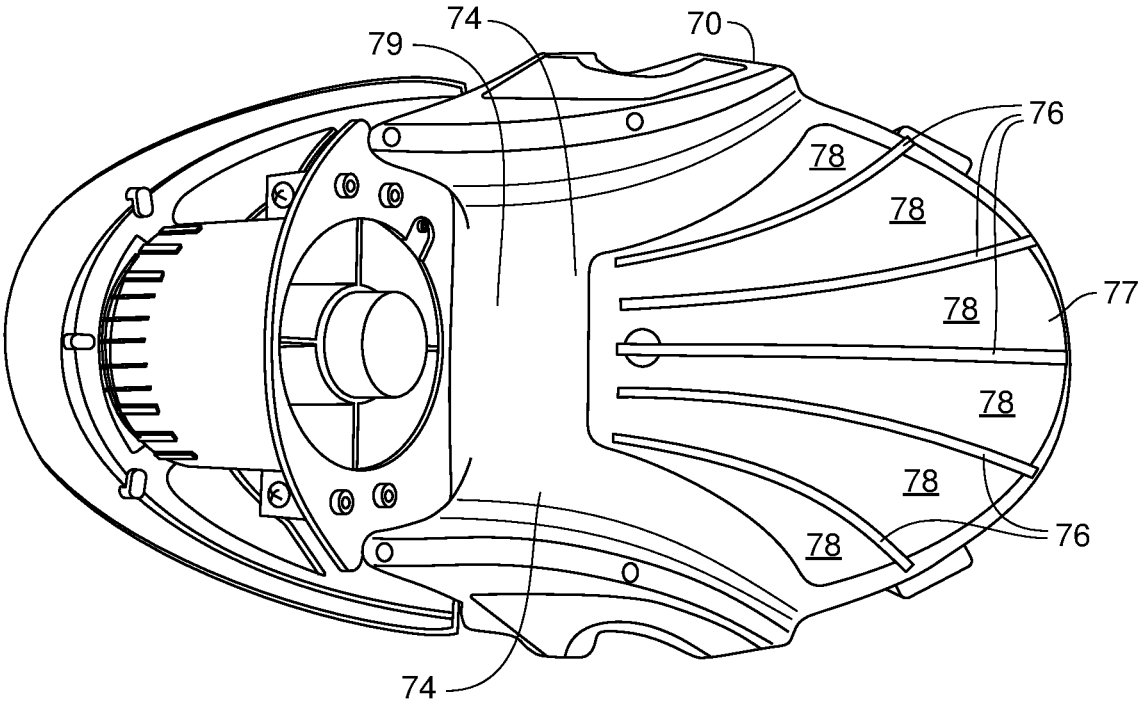
FIG. 13 is a top plan view of the embodiment of FIG. 12.

Turning now to the functionality of the air filter system 20 within the helmet 10, FIGS. 4-5 illustrate the components of the helmet 10 that are utilized to allow air flow to pass through the cartridge 50 and eventually form the curtain of air at front 16 of the helmet 10. The pathway and particular manner in which airflow passes through the helmet 10 is best shown in FIGS. 12 and 13.

As indicated above, a fan or blower 42 draws air flow, represented by arrows 60 through the filter medium 52 of the cartridge 50 via openings 28 and 56. Having passed through the filter cartridge 50, air 60 is then pulled into the fan/blower 42 and then pushed into the air passage inlet 72 of the hat 10 shown in FIGS. 4-5.

Fan/blower 42 is any sort of powered fan/blower sized to fit into the fan mount location 48 of the interior framework 70 of the hat 10. The fan mount location 48 may be formed as part of a unitary whole of the interior framework 70. The fan 42 may be mounted to the fan mount location 48 through any of a variety of known techniques, such as a plurality of screws or rivets. Furthermore, the fan 42 may be powered by any desired mechanism, but in at least one embodiment is powered by batteries or a battery pack (not shown) that is located within the shell 12 of the hat 10, or in the embodiments shown is external to the hat 10 and connected there to by a port 75 (visible in FIGS. 4 and 6).

Interior framework 70 is a structure or structures that underlies the shell 12 (shown in FIGS. 1-2 and 4-5). The framework 70 has a length that extends from the fan 42 to the front 16 of the hat 10. The framework 70 may be made of any suitable material for containing and directing the flow of air 60 provided by fan/blower 42. Such materials may include light weight plastic, polymers, rubber (natural or synthetic) or even reinforced cardstock (cardboard) or other easily replaced material. The interior framework 70 may be formed separately from, and then attached to the shell 12, or the shell 12 and interior framework 70 may be formed as a unitary entity.

As is shown in FIG. 12-13, air 60 passes through the fan/blower 42 and into an air passage inlet 72. The air passage inlet 72 is defined by the combination of the interior framework 70 and shell 12, and is the first portion of the air passage 74 within the helmet interior. The airflow passage 74 is in fluid communication with the fan 42 and extends all the way to the front 16 of the hat 10 to provide fluid (air) passage from the fan/blower 42 to the front 16 of the hat 10. This airflow passage 74 may be divided by the presence of a plurality of walls 76 that form air directing channels 78 therebetween. In some embodiments, the walls 76 form channels 78 that expand in width along their length, such that a channel 78 may be wider at the channel opening 80, toward the front 16 of the hat 10, and narrower at the inlet 72 such as in the manner shown in FIG. 13.

The internal framework 70 may be a single molded plastic (or other material) structure containing the walls 76. Alternatively, and in the embodiments shown in FIGS. 4-6 and 12, the internal framework 70 is a two piece structure including an insert 77 that defines the walls 76 and the predominant air directing channels 78.

Walls 76 may extend the entire length of the framework 70 or only partially along that length such as in the manner shown in FIGS. 12-13. In these figures, the walls 76 begin relatively far along the air flow passage 74 of the helmet. This leaves an unwalled cavity 79 in the airflow passage 74 in which the air exiting the fan/blower 72 first enters. The lack of walls ensures a relatively even pressure of air within this cavity, helping to equalize the air flow that passes through each of the channels 78 formed by the walls 76. The entire airflow path, consisting of the unwalled cavity 79 and the channels 78, extend from the fan/blower 42 over the head of the user 100 and are in fluid communication with the front 16 and/or bill 14 of the hat 10 (see FIG. 1). Air 60 is pushed into the unwalled cavity 79 and into the channels 78 by fan/blower 42, whereupon it exits the channels 78 through channel outlets 80. The air 60 exiting the channel outlets 80 forms the aforementioned stream or "shield" of filtered air 60, which passes in front of the user's eyes or eyewear with sufficient velocity to repel particles of paint, dust, fumes and similar industrial contaminants. In the embodiment shown in FIG. 13, the unwalled cavity 79 takes up between one-fifth and one-half of the airflow path between the exit of the fan/blower 42 and the exit of the interior space at the front 16 of the helmet.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A hat comprising:

a) a shell having:

i) a front and a back, ii) fan mount location located proximal to the back of the a shell, iii) an air passage having an air passage inlet and an air passage outlet, the air passage outlet being located proximal to the front of the shell, and iv) a filtered air receptacle proximal to the back of the shell, the filtered air receptacle having an opening;

b) a fan mounted on the fan mount location of the shell and having a fan inlet and outlet, wherein the fan inlet is mounted in fluid connection with the filtered air receptacle and the fan outlet is mounted in fluid connection with the air passage inlet; and c) an air filtration system removeably positioned over the opening of the filtered air receptacle, the air filtration system having:

i) a retaining basket defining a plurality of basket openings therethrough, the retaining basket being removeably engaged to the back of the shell and defining an interior, and ii) a filter cartridge having a filter medium, the filter cartridge being removeably engaged to the interior of the retaining basket.

2. The hat of claim 1, wherein the filter medium has a porosity, the porosity of the filter medium allowing air drawn into the air-inlet and through the filter medium by the fan to pass therethrough but which blocks and retains particulate matter therein.

3. The hat of claim 2, wherein particulate matter includes liquids and fumes.

4. The hat of claim 1, wherein the filter cartridge includes a support frame, the filter medium being engaged to the support frame.

5. The hat of claim 1, wherein the air passage is divided into a plurality of air flow channels, each air flow channel is defined by walls extending along a portion of a length of the airflow channel, further wherein each air flow channel defines a channel outlet, and further the plurality of channel outlets define the air passage outlet.

6. The hat of claim 5, wherein air passing through the channel outlets forms a stream of air.

7. The hat of claim 6, wherein the channel outlets correspond to a position on the hat such that air flowing through the channel outlets passes over a face of a wearer of the hat.

8. The hat of claim 5, wherein the air passage inlet is an unwalled cavity comprising at least twenty percent of the length of the air passage and wherein the plurality of air flow channels comprise at least fifty percent of the length of the air passage.

9. The hat of claim 4, wherein the filter cartridge is chevron shaped.

10. The hat of claim 9, wherein the filter cartridge has a support frame comprising a top member, a bottom member, and two side members;

the top member having an external surface having a length, at least a portion of the length of the top member external surface defining a curve;

the bottom member having an external surface having a length, the entire length of the bottom member external surface defining a curve.

11. The hat of claim 10, wherein the length of the top member external surface is longer than the length of the bottom member external surface.

12. The hat of claim 11, wherein the plurality of basket openings is three openings, the three openings comprising two side openings and a central opening positioned between the two side openings, each opening has an area, wherein the area of each side opening is smaller than the area of the central opening.

13. The hat of claim 12, wherein the basket is further comprised of two basket cross-bars separating the side openings from the central opening.

14. The hat of claim 13, wherein the support frame of the filter cartridge has two frame cross-bars extending from the top member to the bottom member, further wherein the two frame cross-bars are positioned adjacent the two basket cross-bars when the filter cartridge is engaged to the retaining basket.

15. A filter system comprising a filter cartridge, the filter cartridge comprising:

a) a cage and a filter medium secured to the cage, the cage defining a three cage openings, the filter medium being positioned over the cage openings;

b) the cage consisting of a top member, a bottom member, two side members and two cross-bars, each of the two side members extending between ends of the top member and the bottom member to form junctions;

c) the top member having a top member external surface and a length, the bottom member having a bottom member external surface and a length, the length of the top member external surface being longer than the length of the bottom member external surface, at least a portion of the length of the top member external surface defining a curve, the entire length of the bottom portion external surface defining a curve;

d) the two cross-bars extending between the top member and the bottom member, each cross-bar partially defining at least one opening of the three cage openings;

e) each of the cage openings having an area, one of the plurality of openings being a central cage opening and having an area greater than that of each of the plurality cage openings adjacent thereto.

16. The system of claim 15, wherein the central cage opening has a top side defined by the top member and a bottom side defined by the bottom member, the top side defining a curve, the curve of the top side being parallel to the curve of the top member external surface.

17. The system of claim 16, wherein the bottom side defines a curve, the curve of the bottom side being parallel to the curve of the bottom portion external surface.

18. The system of claim 15, further comprising a retaining basket, the filter cartridge constructed and arranged to be removeably engaged to the retaining basket, the retaining basket defining a plurality of basket openings therethrough, each of the plurality of basket openings overlapping one of the plurality of cage openings.

19. The system of claim 18, further comprising a hat, the hat defining an air flow path way extending from a front of the hat to a back of the hat, the hat containing a fan at the back of the hat within a fan housing, the filter cartridge being positioned adjacent to the fan, the retaining basket being engaged to the back of the hat over the fan housing.

20. The system of claim 19, wherein the fan is constructed and arranged to draw air flow through filter medium of the filter cartridge via the plurality of cage openings and the plurality of basket openings and direct said airflow through the air flow path to the front of the hat.

* * * * *